US007756285B2

(12) United States Patent
Sjursen et al.

(10) Patent No.: US 7,756,285 B2
(45) Date of Patent: Jul. 13, 2010

(54) HEARING AID WITH TUNED MICROPHONE CAVITY

(75) Inventors: Walter P. Sjursen, Washington Crossing, PA (US); Michael DeSalvo, Princeton, NJ (US); Hassan A. Mohammed, Bayonne, NJ (US)

(73) Assignee: Songbird Hearing, Inc., North Brunswick, NJ (US)

( * ) Notice: Subject to any disclaimer, the term of this patent is extended or adjusted under 35 U.S.C. 154(b) by 1049 days.

(21) Appl. No.: 11/343,906

(22) Filed: Jan. 30, 2006

(65) Prior Publication Data

US 2007/0189563 A1 Aug. 16, 2007

(51) Int. Cl.
*H04R 25/00* (2006.01)

(52) U.S. Cl. ..... 381/328; 381/322; 381/324

(58) Field of Classification Search ..... 381/23.1, 381/322–324, 327–328, 330
See application file for complete search history.

(56) References Cited

U.S. PATENT DOCUMENTS 3,876,843 A * 4/1975 Moen ..... 381/313
4,081,782 A 3/1978 Hildreth et al.
4,117,444 A 9/1978 Hildreth et al.
4,467,145 A 8/1984 Borstel
4,550,227 A 10/1985 Topholm
4,736,430 A 4/1988 Schroder
D297,979 S 10/1988 Voroba et al.
4,803,458 A 2/1989 Trine et al.
4,922,540 A 5/1990 Erbe
5,341,433 A 8/1994 Meyer et al.
5,404,407 A 4/1995 Weiss
5,463,692 A 10/1995 Fackler
5,588,064 A 12/1996 McSwiggen et al.
5,687,242 A 11/1997 Iburg
5,751,820 A 5/1998 Taenzer
5,757,933 A 5/1998 Preves et al.
D397,796 S 9/1998 Yabe et al.
5,825,896 A 10/1998 Leedom
5,881,159 A 3/1999 Aceti et al.
D412,987 S 8/1999 Borowsky et al.
6,058,198 A 5/2000 Aceti et al.

(Continued)

FOREIGN PATENT DOCUMENTS

WO WO 03/047307 A2 6/2003

(Continued)

*Primary Examiner*—Suhan Ni
(74) *Attorney, Agent, or Firm*—Hamilton, Brook, Smith & Reynolds, P.C.

(57) ABSTRACT

A hearing aid comprises a microphone that receives incident sound waves from one or more sources external to the hearing aid, and converts the sound waves into electronic signals; a circuit that amplifies the electronic signals; a receiver that converts the amplified electronic signals into amplified sound waves; and a tuned resonant cavity between the microphone and the at least one external sound source. At least one parameter of the tuned resonant cavity is selected to modify the frequency response of the incident sound waves that are received by the microphone. In particular, the geometry of one or more openings through which sound waves enter the chamber, the geometry of the chamber itself, and/or the geometry of one or more openings through which sound waves exit the chamber, are selected to condition the incident sound waves by modifying the frequency response of the audio signal prior to the signal being received at the microphone.

32 Claims, 4 Drawing Sheets

U.S. PATENT DOCUMENTS 6,069,963 A * 5/2000 Martin et al. ..... 381/313
6,104,822 A 8/2000 Melanson et al.
D431,294 S 9/2000 Barnard et al.
6,205,227 B1 3/2001 Mahoney et al.
6,292,571 B1 9/2001 Sjursen
6,366,678 B1 4/2002 Madaffari et al.
6,389,143 B1 5/2002 Leedom et al.
6,410,997 B1 6/2002 Sjursen et al.
6,473,511 B1 10/2002 Aceti et al.
6,473,513 B1 10/2002 Shennib et al.
D468,301 S 1/2003 Fushimi
6,567,525 B1 5/2003 Sapiejewski
6,567,527 B1 5/2003 Baker et al.
6,630,639 B2 10/2003 McSwiggen
6,694,034 B2 2/2004 Julstrom et al.
6,724,902 B1 4/2004 Shennib et al.
6,731,768 B1 5/2004 Delage
6,766,031 B1 7/2004 Westermann
6,865,279 B2 3/2005 Leedom
6,914,994 B1 7/2005 Shennib et al.
6,927,632 B2 8/2005 Sjursen et al.
6,940,988 B1 9/2005 Shennib et al.
6,940,989 B1 9/2005 Shennib et al.
7,003,127 B1 2/2006 Sjursen et al.
7,010,137 B1 3/2006 Leedom et al.
7,082,206 B2 7/2006 Mahoney et al.
7,092,543 B1 8/2006 Mahoney et al.
7,113,611 B2 9/2006 Leedom et al.
7,221,768 B2 5/2007 Sjursen et al.
D554,756 S 11/2007 Sjursen et al.
7,298,857 B2 11/2007 Shennib et al.
7,313,245 B1 12/2007 Shennib et al.
7,372,973 B2 * 5/2008 Meier ..... 381/313
7,403,629 B1 7/2008 Aceti et al.
7,424,124 B2 9/2008 Shennib et al.
7,433,482 B2 * 10/2008 Wehner ..... 381/313
2002/0085728 A1 7/2002 Shennib et al.
2004/0081328 A1 4/2004 Leedom et al.
2004/0240695 A1 12/2004 Leedom et al.
2005/0053251 A1 3/2005 King
2005/0190938 A1 9/2005 Shennib et al.
2005/0259840 A1 11/2005 Gable et al.
2006/0002574 A1 1/2006 Shennib et al.
2006/0050914 A1 3/2006 Urso et al.
2006/0215862 A1 9/2006 Huynh et al.
2006/0291682 A1 12/2006 Urso et al.
2006/0291683 A1 12/2006 Urso et al.
2007/0003081 A1 1/2007 Ram et al.
2007/0003084 A1 1/2007 Huynh et al.
2007/0003087 A1 1/2007 Ram et al.
2007/0009128 A1 1/2007 Mahoney et al.
2007/0036379 A1 2/2007 Anderson et al.
2007/0071265 A1 3/2007 Leedom et al.
2007/0121967 A1 5/2007 Sjursen et al.
2007/0154042 A1 7/2007 Buckley et al.
2007/0177749 A1 8/2007 Sjursen et al.
2007/0189563 A1 8/2007 Sjursen et al.

FOREIGN PATENT DOCUMENTS

WO WO 03/096745 A1 11/2003
WO WO 2005/006715 A2 1/2005

* cited by examiner

HEARING AID WITH TUNED MICROPHONE CAVITY

RELATED APPLICATIONS

This application is related to a co-pending U.S. Utility application Ser. No. 11/343,969, filed Jan. 30, 2005 entitled "Hearing Aid Circuit With Integrated Switch and Battery," in the name of Walter P. Sjursen, Michael DeSalvo, Hassan A. Mohamed, Paul J. Mulhauser, and Karl D. Kirk III. This application is also related to a co-pending U.S. Design Pat. No. 29/253,043, filed Jan. 30, 2006 entitled "Hearing Aid," in the name of Walter P. Sjursen, Michael DeSalvo, Hassan A. Mohamed, Paul J. Mulhauser and Karl D. Kirk, III. The entire teachings of the above applications are incorporated herein by reference.

BACKGROUND OF THE INVENTION

A hearing aid, in general, comprises a housing or ear mold which contains a receiver, a microphone, electronic circuitry connecting the receiver and the microphone, and a battery for operating the electronic circuitry. The housing is an ear mold which fits into the ear canal of the user.

In a conventional hearing aid, the microphone converts incident sound waves into an analog electrical signal which is then processed to filter out unwanted noise etc., amplified, and coupled to a receiver or speaker which converts the electrical signal back to sound waves. The electrical signal processor may be an analog processor which operates directly upon an analog electrical signal. Alternatively, the analog signal may be converted to a digital signal and processed by a digital signal processor (DSP). Typically, the signal processing circuitry is designed to provide a particular frequency response in order to compensate for the type of hearing loss suffered by the user. For example, one common type of hearing impairment is the difficulty in hearing soft sounds at high audible frequencies. Thus, it is common for the signal processing scheme of a hearing aid to increase the gain of these high-frequency sounds relative to lower frequency sounds.

There has been a growing need for small, reliable, easy to use low-cost hearing aids. In particular, it would be desirable to be able to provide a low-cost hearing aid design that could meet the needs of the vast majority of users experiencing age related hearing loss.

One approach to meet these goals has been the development of low-cost, mass-produced hearing aids, including disposable hearing aids. The disposable hearing aid is of a structure that is so inexpensive to manufacture that it is possible to merely replace the whole hearing aid, rather than just the battery, when the battery runs out. Thus, the life of a disposable hearing aid is dependent on the life of the battery. Examples of disposable hearing aids are described in, for example, U.S. Pat. No. 5,881,159 to Aceti et al., U.S. Pat. No. 6,058,198 to Aceti et al., U.S. Pat. No. 6,473,511 to Aceti et al., and U.S. Pat. No. 6,865,279 to Leedom, and in U.S. patent application Ser. No. 09/804,978 to Leedom et al., and Ser. No. 10/688,099 to Leedom et al., the entire teachings of which are incorporated herein by reference.

A limiting factor on the development of high-quality, inexpensive hearing aids is that many of the component parts of these devices, such as the signal processing circuitry, remain relatively expensive. Thus, there is a need to further reduce the cost of hearing aids.

SUMMARY OF THE INVENTION

A hearing aid comprises a microphone that receives incident sound waves from one or more sources external to the hearing aid, and converts the sound waves into electronic signals; a circuit that amplifies the electronic signals; a receiver that converts the amplified electronic signals into amplified sound waves; and a tuned resonant cavity between the microphone and the at least one external sound source. At least one parameter of the tuned resonant cavity is selected to modify the frequency response of the incident sound waves that are received by the microphone. In particular, the geometry of one or more openings through which sound waves enter the chamber, the geometry of the chamber itself, and/or the geometry of one or more openings through which sound waves exit the chamber, are selected to condition the incident sound waves by modifying the frequency response of the audio signal prior to the signal being received at the microphone.

In one aspect, the tuned resonant cavity acts much like a passive acoustical filter. The geometry of the cavity is designed to provide a desired frequency response in the incident audio signal. For instance, the geometry of the cavity can result in certain audio frequencies, or ranges of frequencies, being amplified or attenuated relative to the other frequencies, resulting in a conditioned or filtered audio signal being received at the microphone. The physical characteristics of the tuned resonant cavity can be represented as an electronic circuit, specifically an RLC circuit, and the frequency response of the sound waves in the cavity can be analyzed by reference to the frequency response of the corresponding electrical circuit representation of the cavity.

In general, the incident sound waves that are conditioned by the resonant cavity can comprise sound waves having frequencies between 1 and 10 kHz, and more specifically between 5 and 7 kHz. The parameters of the resonant cavity that can be selected to condition the incident sound waves include, for example, the number of entrance holes into the cavity, the cross-sectional area of the entrance hole(s), and the shape of the entrance hole(s). In addition, the number of exit holes from the cavity, the cross-sectional area of the exit hole(s) and the shape of the exit hole(s) can also be selected. Other parameters of the resonant cavity that can be selected include the volume of the cavity, the shape of the cavity, and the materials of the cavity.

An advantage of the present hearing aid is that the tuned resonant cavity can be designed to provide a frequency response(s) that help compensate for various types of hearing loss. For instance, the tuned resonant cavity can be designed to increase the gain at higher frequencies relative to lower frequencies in the incident sound signal, since one common type of hearing impairment is a difficulty in hearing low-volume, high-frequency sounds. The tuned resonant cavity can help reduce the cost of the hearing aid, since the passive conditioning of the incident sound waves afforded by the tuned resonant cavity minimizes the requirements of the signal processing electronics. Thus, smaller, less complex, and/or less expensive circuitry can be employed. In addition, because the tuned resonant cavity is a passive component that does not consume any electrical power, the power requirements of the hearing aid are reduced. This is particularly important in the context of a disposable hearing aid, since lower power requirements translate to a longer useful life for the hearing aid.

In certain embodiments, the tuned resonant cavity is an integral component of the hearing aid. For example, the cavity can comprise a portion of a hearing aid shell that contains the hearing aid electronic components (e.g., the microphone, battery, circuitry, and receiver). The hearing aid shell can comprise a face plate having one or more openings for sound waves. The microphone can be mounted generally parallel and spaced away from the face plate within the hearing aid shell, and the tuned resonant cavity can comprise the interior volume of the shell between the face plate and the microphone. Preferably, the tuned resonant cavity is substantially acoustically isolated from the rest of the hearing aid shell. For instance, the microphone can be sealed into the interior of the shell (by a gasket or o-ring, for example), so that sound is contained in the tuned resonant cavity. If necessary, a small opening can be provided to permit air to travel behind the microphone into the interior of the hearing aid shell (for example, to provide oxygen for an air-activated battery). However, the acoustical impedance of this opening is preferably sufficiently high to substantially prevent audible sound waves from exiting the cavity through the opening.

In other embodiments, the tuned resonant cavity comprises a component that is mounted to or within the hearing aid. The cavity can be separately manufactured for incorporation within the hearing aid. An advantage of this is that the geometry of the cavity can generally be more precisely controlled than in the case where the resonant cavity is formed from the hearing aid shell. In certain embodiments, the tuned resonant cavity can comprise a conduit that is mounted in front of the microphone. The conduit can have any practical size and shape. It can have a cross-section that is substantially circular, elliptical, triangular, rectangular, or irregularly-shaped. Preferably, a first end of the conduit contacts a surface of the microphone. The cross-sectional area of the first end of the conduit is preferably approximately equal to the area of the microphone diaphragm, and the first end of the conduit can be substantially aligned with the diaphragm. Preferably, the interface between the first end of the conduit and the microphone diaphragm is substantially sealed, so that the sound waves in the conduit are directed into the microphone diaphragm.

In another aspect, the first end of the conduit comprises a flange that extends radially from the conduit. The conduit can comprise part of a switching mechanism for modifying an operating state of the hearing aid. In one embodiment, at least one switch trace for the switching mechanism is mounted directly or indirectly on the flange of the conduit. For example, a circuit board can be mounted on the flange of the conduit, and at least one switch trace can be located on the circuit board. Preferably, the circuit board comprises a flexible circuit board that is mounted on the flange. The flange supports the flexible circuit board, and functions as a stiffener for the circuit board.

In another aspect, the conduit functions as a shaft such that a component of the switching mechanism rotates around the conduit. Preferably, the switching mechanism comprises a rotary switch that is rotatable around the conduit. The rotary switch can comprise one or more electrical contacts that engage with the switch trace(s) as the rotary switch is rotated around the conduit.

The second end of the conduit receives incident sound waves, and can extend partially or completely through a face plate of the hearing aid.

In another aspect of the invention, a hearing aid comprises a plurality of tuned resonant cavities between the microphone and the at least one external sound source. In certain embodiments, at least two tuned resonant cavities are arranged in series. In yet further embodiments, at least two tuned resonant cavities are arranged in parallel. A series of tuned resonant cavities can be used, for example, to provide a notch filter to selectively modify various frequency bands over a frequency spectrum of interest.

A method for manufacturing a hearing aid comprises providing a microphone that receives incident sound waves from one or more sources external to the hearing aid, and converts the sound waves into electronic signals; providing a circuit that amplifies the electronic signals; providing a receiver that converts the amplified electronic signals into amplified sound waves; selecting parameters for a tuned resonant cavity to modify the frequency response of the incident sound waves; and providing a tuned resonant cavity comprising the selected parameters between the microphone and the at least one external sound source. The selected parameters include at least one of the geometry of one or more openings through which sound waves enter the cavity, the geometry of the cavity, and the geometry of one or more openings through which sound waves exit the cavity.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
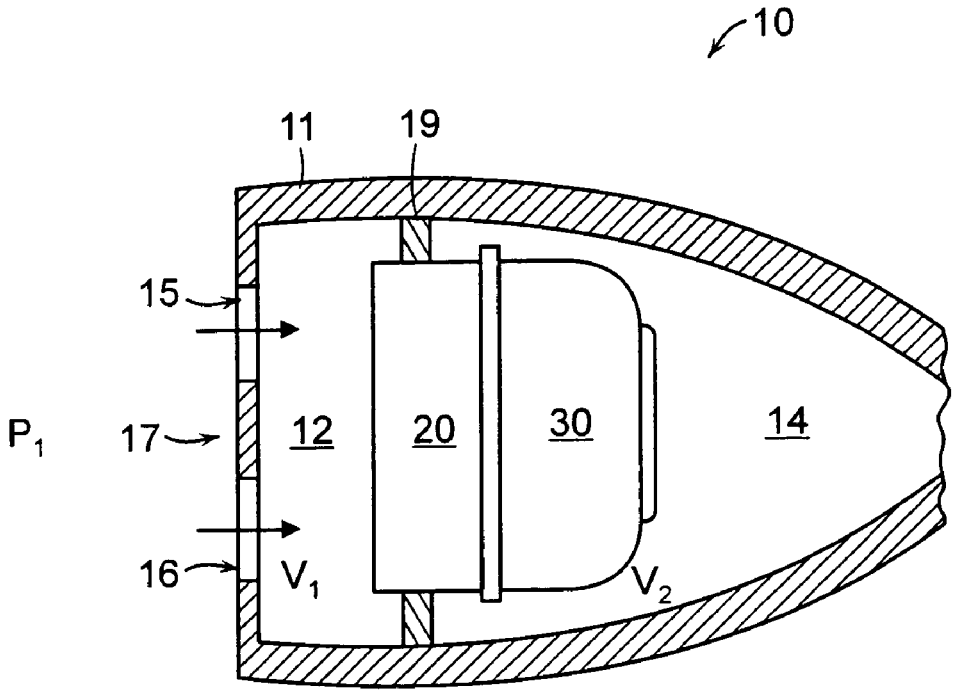
FIG. 1 is a side cross-sectional view of one embodiment of a hearing aid with tuned resonant cavity.

A hearing aid 10 having a tuned resonant cavity 12 is shown in FIG. 1. As shown in this figure, the hearing aid 10 includes a hearing aid shell 11 that contains various hearing aid components, such as a microphone 20 and battery 30, as is known in the art. The hearing aid shell 11 includes a face plate 17 located at the front end of the device. The face plate 17 includes a pair of openings 15, 16 that allow air and sound into the tuned resonant cavity 12. The resonant cavity 12 is tuned by selecting one or more parameters of the cavity, including the number, shapes and sizes of the openings 15, 16, and the shape and volume of the chamber 12. Additionally, the cavity can be tuned by selecting the number, shapes and sizes of any opening(s) between the chamber 12 and the microphone 20. By adjusting these parameters, the cavity 12 can effectively "tune" the incident sound wave signal, $P_1$, to provide a desired frequency response characteristic prior to the acoustic signal being received at microphone 20. In this respect, the tuned resonant cavity acts much like a passive acoustical filter.

In one aspect, the physical characteristics of the tuned resonant cavity 12 can be represented as an electronic circuit, specifically an RLC circuit (a circuit with resistors, inductors and capacitors), and the frequency response of the sound waves in the cavity can be analyzed by reference to the frequency response of the corresponding electrical circuit representation of the cavity. The RLC circuit analogy has been known in the field of acoustical engineering as a useful model for designing acoustically-tuned structures. The present inventors have discovered that this model is particularly advantageous for designing an acoustically tuned microphone cavity for a hearing aid.

In prior hearing aids, signal processing is performed electronically by the hearing aid electronic circuitry, after the incident acoustic signal has been transformed into an electrical signal by the hearing aid microphone. In the present hearing aid, at least a portion of the signal processing can be performed acoustically through the use of a tuned resonant cavity in front of the microphone. An example of the signal processing capability of the tuned resonant cavity is illustrated in the electronic circuit representation of the cavity shown in FIG. 2A. In this diagram, the tuned resonant cavity is represented by 12. The incident sound wave signal $P_1$ can be represented as an input voltage signal. The pair of openings 15, 16 to the cavity can be represented by a pair of parallel impedences. The volume of the cavity, $V_1$, can be represented as a capacitor. The acoustic signal received at microphone 20 can be represented as an output voltage signal.

Figure 2A:
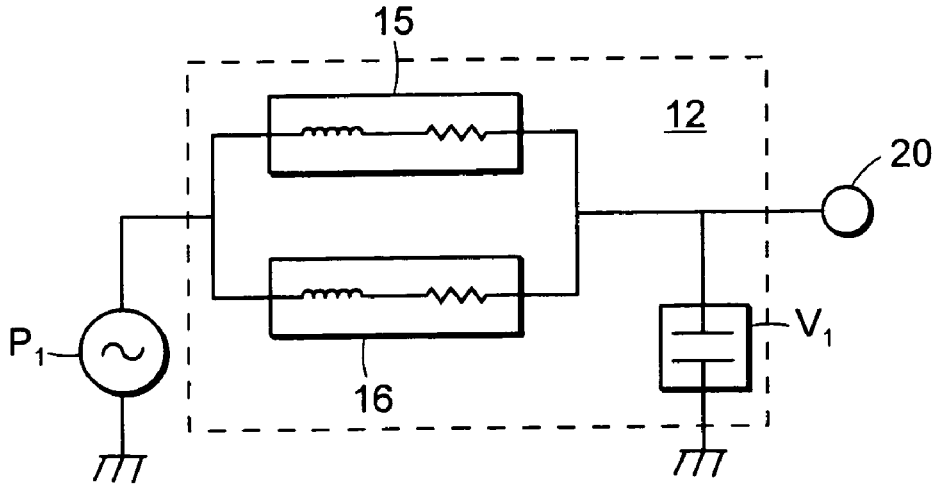
FIG. 2A is an electronic circuit representation of the tuned resonant cavity of FIG. 1.

In the exemplary embodiment shown in FIGS. 1 and 2A, by adjusting the size of the air inlet hole(s) of the cavity, and the volume of the cavity (i.e. the impedence and capacitance, respectively, of the acoustic circuit), the frequency response of the output signal can be modified.

The air openings 15, 16 form an acoustical mass-resistance element where the acoustical mass or inertance (inductance in the equivalent electrical circuit) and resistance (resistance in the equivalent electrical circuit) increase with the length of the opening (i.e., thickness of the faceplate) and decrease as the area of the opening increases. The relationships are not linear and the resistance generally is also dependent on the frequency.

For small acoustical cavities, the acoustical impedance (compliance) is represented by a capacitance in the equivalent electrical circuit. The capacitance is proportional to the volume of the cavity, $V_1$.

By increasing the volume of the cavity, the capacitance is increased and the resonant frequency is decreased. By increasing the area of the openings 15, 16, the inductance and resistance are decreased and the resonant frequency is increased. By adjusting the size and number of openings and the volume of the cavity, one can adjust the resonant frequency as well as the amount of high-frequency boost relative to the low frequencies.

In the hearing aid of FIG. 1, a sealing member 19 occupies the volume of the hearing aid between the microphone 20 and the interior of the shell 11. The sealing member isolates the tuned resonant cavity 12 from the remaining volume of the hearing aid 14. Cavity 12 can be "tuned," for example, by modifying the size of the cavity 12. This can be accomplished in any practical manner, such as by adjusting the size and/or location of the sealing member 19, filling a portion of the cavity 12 with a potting substance (such as an epoxy), or by adjusting the spacing between microphone 20 and face plate 17. Similarly, the cavity 12 can be easily tuned by adjusting the size and/or number of air inlet hole(s) 15, 16. By way of example, reducing the volume of the cavity 12 and increasing the size of the air inlet holes 15, 16, the resonant frequency of the cavity is increased, and the high-frequency sounds can be boosted relative to the low frequency sounds.

In general, the incident sound waves that are conditioned by the resonant cavity can comprise sound waves having frequencies between 1 kHz and 10 kHz, and more specifically between 5 kHz and 7 kHz. The cavity can be tuned to any reasonable frequency in the audio range for humans and pets, generally between 20 Hz and about 70 kHz, though typically tuning the cavity to frequencies between 1 kHz and 10 kHz is most beneficial for hearing aids. The tuned resonant cavity of the present invention is advantageously able to "pre-condition" the incident acoustic signal using passive, acoustical means. Preferably, this passive "pre-conditioning" is used in conjunction with conventional electronic signal processing of the hearing aid circuitry. In preferred embodiments, the passive "pre-conditioning" works in conjunction with the signal processing scheme of the hearing aid circuitry, and can therefore lessen at least a portion of the processing requirements of the circuitry. This can help reduce the cost of the signal processing circuitry, and can also reduce the power requirements of the hearing aid.

Figure 3:
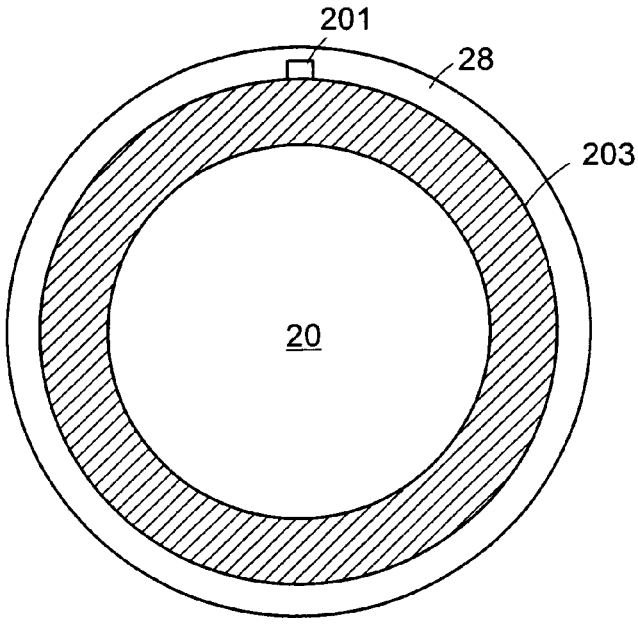
FIG. 3 is a cross-sectional front-view of a sealing gasket and air hole.
Figure 4:
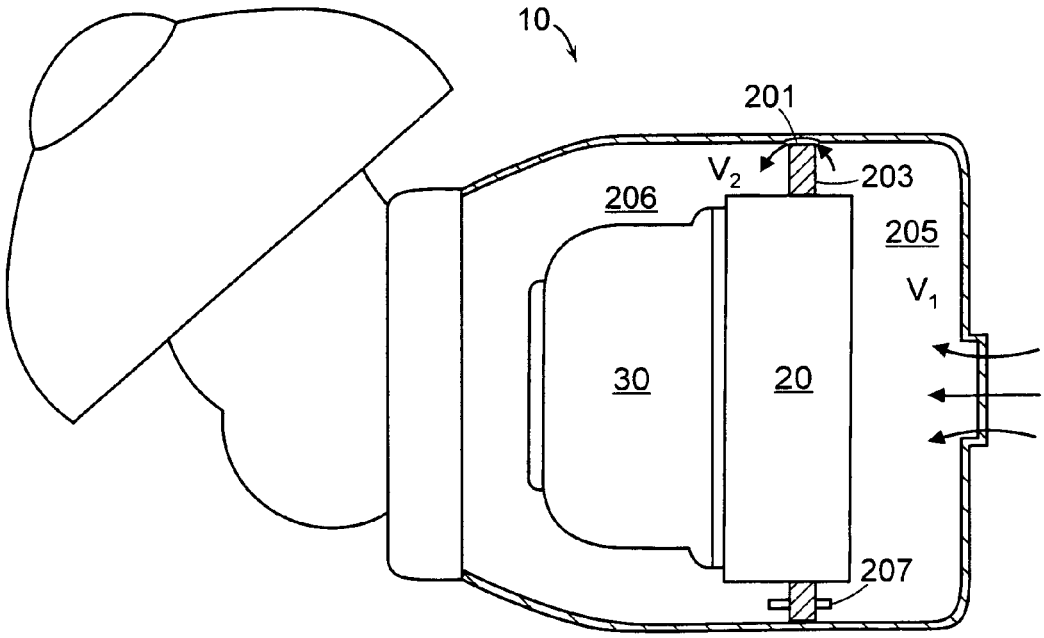
FIG. 4 is a side cross-sectional view of the hearing aid microphone of FIG. 3.

Turning now to FIGS. 3 and 4, yet another aspect of the invention is illustrated. FIG. 3 shows a cross-section of a hearing aid according to one embodiment of the invention. As shown in this figure, the hearing aid microphone 20 is located within the hearing aid shell 28. As in the embodiment of FIG. 1, a sealing member 203, such as a gasket or o-ring, concentrically surrounds the periphery of the microphone 20, and substantially completely fills the area of the hearing aid between the outer periphery of the microphone and the interior surface of the hearing aid shell 28. The sealing member 203 surrounding the microphone 20 is shown in the side view of FIG. 4.

In certain embodiments, it is necessary to provide air to the volume 14 of the hearing aid behind the microphone 20. For instance, where the hearing aid uses an air-activated battery 30, it is required that a certain amount of air is able to exit the resonant cavity 12 and pass behind the microphone 20 to reach the battery 30.

As shown in FIGS. 3 and 4, an air vent 201 is provided to allow air to pass behind the sealing member 203 to the interior portion 206 of the hearing aid housing, which includes the battery 30. In the embodiment illustrated in FIG. 3, the air vent 201 comprises a slot that is molded into the interior of the hearing aid shell 28. In this embodiment, the slot is about 8-mils wide and about 12-mils deep. Other shapes and sizes for the vent could also be used. In addition, multiple vents could be employed. The vent could also comprise a passageway through the sealing member 203. For example, as shown in FIG. 4, a hollow tube 207 (such as a hypodermic needle) could be inserted through the sealing member 203 to provide a vent passageway. In addition, the sealing member 203 itself could comprise an air-permeable material to provide the venting of air to the interior of the hearing aid.

Figure 2B:
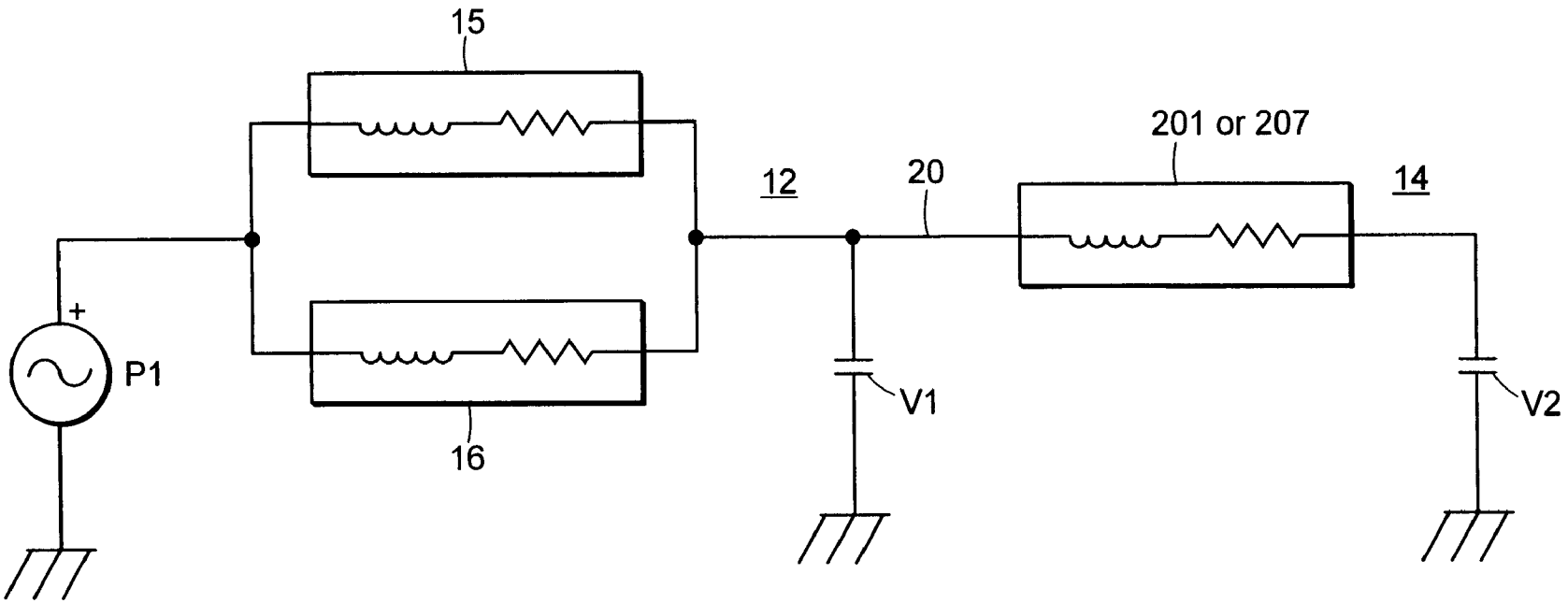
FIG. 2B is an electrical circuit representation showing the impedances of an air vent between two acoustical cavities in a hearing aid.

Preferably, the sealing member and vent arrangement provide an acoustic seal, so that audible sound waves are substantially prevented from entering the interior portion 206 of the hearing aid housing, while a sufficient quantity of air is able to pass through the air vent 201 to provide the necessary oxygen for the battery. In essence, the air vent is configured to provide a relatively high-impedance to audio frequency sound waves, but a relatively low impedance to the diffusion of oxygen to the battery. Said another way, the vent represents a low impedance to very low frequency signals including dc (direct current). However, the air vent does not substantially affect the frequency response of higher frequency signals in the audio range (e.g. 1-10 kHz). The sealing member and vent arrangement are thus air permeable, but substantially impermeable to sound waves in the audible frequencies. FIG. 2B is the electrical circuit representation showing the impedances of an air vent (201 or 207) between two acoustical cavities 205, 206, such as shown in FIGS. 3 and 4.

Figure 5:
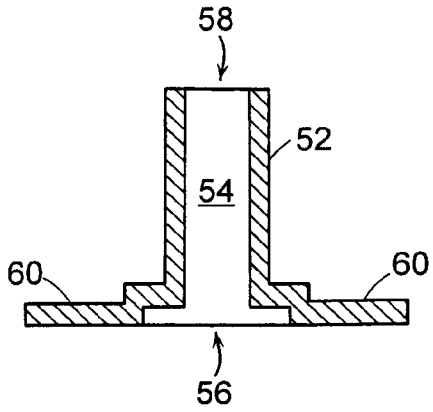
FIG. 5 is a cross-sectional side view of a tuned resonant cavity according to one aspect of the invention.

Turning now to FIG. 5, a cross-sectional side view of a tuned resonant cavity 52 according to one aspect of the invention is shown. In this embodiment, the tuned resonant cavity 52 comprises a separate, optionally one-piece component that can be mounted to or within the hearing aid shell. The cavity can be separately manufactured for incorporation within the hearing aid during hearing aid assembly. An advantage of this design is that the geometry of the cavity can generally be more precisely controlled than in the case where the resonant cavity is formed from the hearing aid shell. For example, the tuned resonant cavity of this embodiment may benefit from comparatively tighter manufacturing tolerances, and may be easier to manufacture than an integrally-formed cavity such as shown in FIG. 1.

Figure 6:
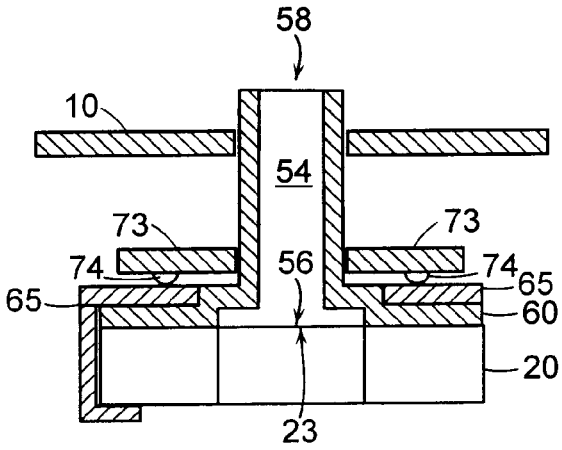
FIG. 6 is a cross-sectional side view of the tuned resonant cavity of FIG. 5 incorporated in a switching mechanism.

In general, the tuned resonant cavity 52 of this embodiment comprises a conduit 54 that may be mounted in front of a hearing aid microphone. The conduit can have any practical size and shape. It can have a cross-section that is substantially circular, elliptical, triangular, rectangular, or irregularly-shaped, for example. The conduit has a first end 56 and a second end 58. Preferably, the first end 56 contacts a surface of the microphone 20, as shown in FIG. 6. The cross-sectional area of the first end of the conduit is preferably approximately equal to the area of the microphone diaphragm 23, and the first end of the conduit can be substantially aligned with the diaphragm 23. Preferably, the interface between the first end 56 of the conduit 54 and the microphone diaphragm 23 is substantially sealed, so that the sound waves in the conduit are directed into the microphone diaphragm 23.

Figure 7:
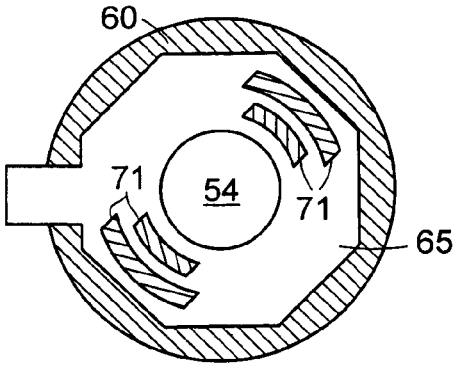
FIG. 7 is a front cross-sectional view of the tuned resonant cavity and switching mechanism of FIG. 6.

In another aspect, the first end 56 of the conduit 54 comprises a flange 60 that extends radially from the conduit 54. The flange 60 can help mount the cavity 54 to the microphone 20. In a preferred embodiment, the cavity 54 can be incorporated into a switching mechanism for the hearing aid. Exemplary embodiments of a hearing aid switching mechanism are described in co-pending U.S. Utility application Ser. No. 11/343,969, filed Jan. 30, 2005 entitled "Hearing Aid Circuit With Integrated Switch and Battery," in the name of Walter P. Sjursen, Michael DeSalvo, Hassan Mohamed, Paul J. Mulhauser, and Karl D. Kirk III, the entire teachings of which have been incorporated herein by reference. In one embodiment of a switching mechanism, at least one switch trace 71 for the switching mechanism is mounted directly or indirectly on the flange 60 of the conduit. In one preferred embodiment, a circuit board 65 is mounted on the flange 60, and at least one switch trace 71 can be located on the circuit board. The circuit board 65 can comprise a flexible circuit board, and the flange can function as a stiffener for the flexible circuit board. The flexible circuit board 65 with switch traces 71 mounted on the flange 60 is more clearly illustrated in the front cross-sectional view of FIG. 7.

In another aspect, the conduit 54 of the cavity 52 functions as a shaft such that a rotary switch 73 is rotatable around the conduit 54. The rotary switch 73 can comprise one or more electrical contacts 74 that engage with the switch traces 71 as the rotary switch 73 is rotated around the conduit. The rotary switch 73 includes a mechanism, such as a tab or protrusion (not shown) that extends through the face plate 17, that permits the user to selectively rotate the contacts 74 into and out of engagement with the switch traces 71, thereby altering the operating state of the hearing aid.

The second end 58 of the conduit 54 comprises one or more openings for introducing incident sound waves into the cavity 54. Preferably, the second end 58 extends partially or completely through the face plate 17 of the hearing aid.

While this invention has been particularly shown and described with references to preferred embodiments thereof, it will be understood by those skilled in the art that various changes in form and details may be made therein without departing from the scope of the invention encompassed by the appended claims.

What is claimed is:

1. A hearing aid, comprising:

a microphone that receives incident sound waves from one or more sources external to the hearing aid, and converts the sound waves into electronic signals;

a circuit that amplifies the electronic signals;

a receiver that converts the amplified electronic signals into amplified sound waves; and a tuned resonant cavity between the microphone and the at least one external sound source, at least one of the following parameters of the tuned resonant cavity being selected to modify the frequency response of the incident sound waves before the sound waves are received by the microphone: a geometry of one or more openings through which sound waves enter the cavity, the geometry of the cavity, and the geometry of one or more openings through which sound waves exit the cavity, the tuned resonant cavity modifying the frequency response of the incident sound waves by increasing the amplitudes of higher frequency sounds relative to lower frequency sounds within the incident sound waves.

2. The hearing aid of claim 1, wherein the incident sound waves comprise sound waves having frequencies between 1 and 10 kHz.

3. The hearing aid of claim 1 wherein the incident sound waves comprise sound waves having frequencies between 5 and 7 kHz.

4. The hearing aid of claim 1, wherein the geometry of the one or more openings through which sound waves enter the cavity comprises a number of openings.

5. The hearing aid of claim 1, wherein the geometry of the one or more openings through which sound waves enter the cavity comprises a cross-sectional area of the opening or openings.

6. The hearing aid of claim 1, wherein the geometry of the one or more openings through which sound waves enter the cavity comprises a shape of the one or more openings.

7. The hearing aid of claim 1, wherein the geometry of the cavity comprises a volume of the cavity.

8. The hearing aid of claim 1, wherein the geometry of the cavity comprises a material that is located within or forms the cavity.

9. The hearing aid of claim 1, wherein the geometry of one or more openings through which sound waves exit the cavity comprises the number of openings.

10. The hearing aid of claim 1, wherein the geometry of one or more openings through which sound waves exit the cavity comprises the cross-sectional area of the opening or openings.

11. The hearing aid of claim 1, wherein the geometry of one or more openings through which sound waves exit the cavity comprises the shape of the at least one opening.

12. The hearing aid of claim 1, wherein the tuned resonant cavity is an integral component of the hearing aid.

13. The hearing aid of claim 12, wherein the tuned resonant cavity comprises at least a portion of a hearing aid shell, the microphone, electronics and receiver being enclosed within the shell.

14. The hearing aid of claim 13, wherein the hearing aid shell comprises a face plate having one or more openings for sound waves, the microphone being generally parallel and spaced apart from the face plate, the tuned resonant cavity comprising a substantially enclosed volume between the face plate and the microphone.

15. The hearing aid of claim 14, wherein the tuned resonant cavity is substantially acoustically isolated from one or more additional volumes within the hearing aid shell.

16. The hearing aid of claim 15, wherein air is permitted to flow from the tuned resonant cavity into the one or more additional volumes.

17. The hearing aid of claim 1, wherein the tuned resonant cavity is mounted to or within the hearing aid.

18. The hearing aid of claim 17, wherein the tuned resonant cavity comprises a conduit mounted in front of the microphone.

19. The hearing aid of claim 18, wherein the conduit has a substantially circular cross-section.

20. The hearing aid of claim 18, wherein a cross-section of the conduit is at least one of elliptical, triangular, rectangular, or irregularly shaped.

21. The hearing aid of claim 17, wherein a first end of the conduit contacts a surface of the microphone.

22. The hearing aid of claim 21, wherein the first end of the conduit a cross-sectional area that is approximately equal to the area of a diaphragm of the microphone, the first end being substantially aligned with the diaphragm.

23. The hearing aid of claim 22, wherein the interface between the first end of the conduit and the microphone diaphragm is substantially sealed.

24. The hearing aid of claim 18, wherein the first end of the conduit comprises a flange extending radially from the conduit.

25. The hearing aid of claim 24, wherein the conduit comprises at least a portion of a switching mechanism for modifying an operating state of the hearing aid.

26. The hearing aid of claim 25, wherein at least one switch trace for the switching mechanism are mounted directly or indirectly on the flange of the conduit.

27. The hearing aid of claim 26, wherein at least a portion of a circuit board is mounted on the flange, the at least one switch trace being located on the circuit board.

28. The hearing aid of claim 27, wherein the circuit board comprises a flexible circuit board, the flexible circuit board being supported by the flange.

29. The hearing aid of claim 25, wherein at least a portion of the switching mechanism is rotatable around the conduit.

30. The hearing aid of claim 29, wherein a rotary switch is rotatable around the conduit, the rotary switch comprising one or more electrical contacts that engage with one or more switch traces as the rotary switch is rotated around the conduit.

31. The hearing aid of claim 30, wherein the at least one switch traces are mounted directly or indirectly on the flange of the conduit.

32. The hearing aid of claim 18, wherein a second end of the conduit extends partially or completely through a face plate of the hearing aid.

* * * * *